US006006723A

United States Patent [19]

Akabori et al.

[11] Patent Number: 6,006,723

[45] Date of Patent: Dec. 28, 1999

[54] IDLE SPEED CONTROL SYSTEM FOR INTERNAL COMBUSTION ENGINE

[75] Inventors: Kouichi Akabori, Kanagawa; Nobutaka Takahashi, Yokohama; Yoshitaka Deguchi, Kanagawa, all of Japan

[73] Assignee: Nissan Motor Co., Ltd., Kanagawa, Japan

[21] Appl. No.: 08/897,824

[22] Filed: Jul. 21, 1997

[30] Foreign Application Priority Data

Jul. 22, 1996 [JP] Japan ..... 8-192311

[51] Int. Cl.[6] ..... F02D 41/08; F02D 41/16

[52] U.S. Cl. ..... 123/339.17

[58] Field of Search ..... 123/339.12, 339.16, 123/339.17, 339.18, 339.23

[56] References Cited

U.S. PATENT DOCUMENTS

| | | | |
|---|---|---|---|
| 4,492,195 | 1/1985 | Takahashi et al. | 123/339 |
| 4,836,164 | 6/1989 | Morozumi et al. | 123/339 |
| 5,619,966 | 4/1997 | Aubourg et al. | 123/339.22 |
| 5,628,290 | 5/1997 | Iida et al. | 123/305 |
| 5,630,394 | 5/1997 | Grizzle et al. | 123/339.23 |

FOREIGN PATENT DOCUMENTS 60-240843 11/1985 Japan .

*Primary Examiner*—Andrew M. Dolinar
*Assistant Examiner*—Mahmoud M. Gimie
*Attorney, Agent, or Firm*—McDermott, Will & Emery

[57] ABSTRACT

When an operation causing a decrease of the engine load is requested, for example, by switching off an air conditioner switch, an idle speed control system calculates a fuel decrease quantity from an engine load decrease quantity, and further calculates an air decrease quantity in accordance with a desired air fuel ratio after the engine load decrease, and the fuel decrease quantity. The control system decreases the air supply quantity to the engine by the air decrease quantity. Then, after the elapse of a preset time interval, the system controls the external load such as the air conditioner so as to reduce the engine load (for example, by turning off the air conditioner), and decrease the fuel injection quantity by the fuel decrease quantity. When the air conditioner is switched on, for example, the control system calculates a fuel increase quantity from the engine load increase, and further calculates an air increase quantity in accordance with the fuel increase quantity and a desired air fuel ratio after the engine load increase. Then, the control system controls the external load to increase the engine load, increases the fuel injection quantity and increases the air supply quantity.

4 Claims, 8 Drawing Sheets

IDLE SPEED CONTROL SYSTEM FOR INTERNAL COMBUSTION ENGINE

BACKGROUND OF THE INVENTION

The present invention relates to system or process for controlling an idle speed of an internal combustion engine substantially constant.

A conventional idle speed control system is arranged to sense an engine speed directly and controls an air quantity (the opening degree of an auxiliary air valve) in a feedback control mode so as to reduce a deviation from a desired idle speed.

When, however, an external load is added, for example, by turning on an air conditioner or shifting an automatic transmission from the neutral position to the D range, the engine speed falls instantaneously. The above-mentioned feedback system is slow in response and ineffectual in preventing an abrupt decrease of the idle speed due to the addition of the external load.

An idle speed control system as disclosed in Japanese Patent Provisional Publication No. 60(1985)-240843 is arranged to detect an addition of an external load and to increase the fuel injection quantity upon detection of the addition of the external load. When the external load is removed, this system decreases the fuel injection quantity.

However, in the system in which the decrease of the fuel injection quantity and the removal of the load are performed simultaneously, the air fuel mixture tends to become too lean. Specifically, in a lean burn engine designed to run on a significantly low air/fuel ratio to improve the fuel consumption, the air/fuel ratio might reach the lean limit by the decrease of the fuel injection quantity, quantity, resulting in poor combustion and unpleasant drive feeling.

On the other hand, the simultaneous operation of increasing the fuel injection quantity and adding the external load makes the air fuel mixture richer, and deteriorates the fuel consumption and exhaust performance.

SUMMARY OF THE INVENTION

It is therefore an object of the present invention to provide an engine idle speed control system or process which can improve the driveability, fuel consumption, and exhaust performance when an external load is removed or added.

According to the present invention, an idle speed control system for controlling an idle speed of an internal combustion engine, comprises load decreasing operation request detecting means, desired air/fuel ratio setting means, fuel decrease quantity calculating means, air decrease quantity calculating means, air supply quantity correcting means, load controlling means, fuel supply quantity correcting means, as shown in FIG. 1.

The load decreasing operation request detecting means detects a load decreasing operation request for an operation decreasing a load on the engine. For example, the load decreasing operation request detecting means detects an operation to turn off an air conditioner of a vehicle.

The desired air/fuel ratio setting means sets a desired air fuel ratio of an air fuel mixture supplied to the engine in accordance with an engine operating condition.

The fuel decrease quantity calculating means calculates a fuel decrease quantity for decreasing a fuel injection quantity when the load decreasing operation request is detected. The fuel decrease quantity calculating means calculates the fuel decrease quantity corresponding to a generated torque required to maintain a desired idle speed from a decrease quantity of the load.

The air decrease quantity calculating means calculates an air decrease quantity for decreasing an air supply quantity in accordance with the desired air fuel ratio for an engine operating condition after the decrease of the load and the above-mentioned fuel decrease quantity when the load decreasing operation request is detected.

The air supply quantity correcting means decreases the air supply quantity in accordance with the air decrease quantity when the load decreasing operation request is detected.

The load controlling means decreases the load on the engine after the elapse of a preset time interval from detection of the load decreasing operation request.

The fuel supply quantity correcting means decreases the fuel injection quantity in accordance with the fuel decrease quantity after the elapse of a preset time interval from detection of the load decreasing operation request.

When the engine load is to be decreased, this control system decreases the air supply quantity in advance and thereby puts the air fuel mixture in such a richer condition as to achieve a predetermined desired air fuel ratio when the fuel injection quantity is decreased in accordance with the decrease of the load. Thus, the control system can compensate for the decrease of the engine load in a responsive and smooth manner. Furthermore, this control system can prevent the air fuel mixture from being made too lean by the decrease of the fuel injection quantity and thereby maintain smooth and agreeable engine idling performance.

This control system decreases the fuel injection quantity simultaneously with the decrease of the load. Therefore, the control system can follow up changes in the load faithfully and responsively. Furthermore, this control system decreases the air supply quantity beforehand to make the air fuel mixture slightly richer. Therefore, this control system can prevent the air fuel mixture from reaching the lean limit by the decrease of the fuel injection quantity and maintain the combustion stable.

According to another aspect of the present invention, an idle speed control system for controlling an idle speed of an internal combustion engine, comprises load increasing operation request detecting means, desired air fuel ratio setting means, fuel increase quantity calculating means, air increase quantity calculating means, load controlling means, fuel supply quantity correcting means and air supply quantity correcting means, as shown in FIG. 2.

The load increasing operation request detecting means detects a load increasing operation request for an operation increasing a load on the engine. For example, the load increasing operation request detecting means detects an operation to turn on an air conditioner of a vehicle.

The desired air/fuel ratio setting means sets a desired air fuel ratio of an air fuel mixture supplied to the engine in accordance with an engine operating condition.

The fuel increase quantity calculating means calculates a fuel increase quantity for increasing a fuel injection quantity in case of detection of the load increasing operation request. The fuel increase quantity calculating means calculates the fuel increase quantity corresponding to a generated torque required to maintain a desired idle speed from an increase quantity of the load.

The air increase quantity calculating means calculates an air increase quantity for increasing an air supply quantity in accordance with the desired air fuel ratio for an engine operating condition after the increase of the load, and the above-mentioned fuel increase quantity in case of detection of the load increasing operation request.

The load controlling means increases the load in case of detection of the load increasing operation request.

The fuel supply quantity correcting means increases the fuel injection quantity in accordance with the fuel increase quantity in case of detection of the load increasing operation request.

The air supply quantity correcting means increases the air supply quantity in accordance with the air increase quantity in case of detection of the load reducing operation request.

When the engine load is to be increased, the control system increases the fuel injection quantity in accordance with the increase quantity of the engine load, and thereafter, increases the air supply quantity so as to attain the desired air/fuel ratio. Thus, the control system can compensate for the increase of the load in a responsive and smooth manner. Furthermore, this control system can improve the fuel economy and the exhaust characteristic by preventing the air/fuel ratio from staying long in the rich condition.

This control system increases the fuel injection quantity simultaneously with the increase of the load. Therefore, the control system can follow up changes in the load faithfully and responsively. Thereafter, the air supply quantity is increased. This control system, therefore, can improve the fuel consumption and the emission control by preventing the air fuel mixture from remaining rich.

DETAILED DESCRIPTION OF THE INVENTION

Figure 3:
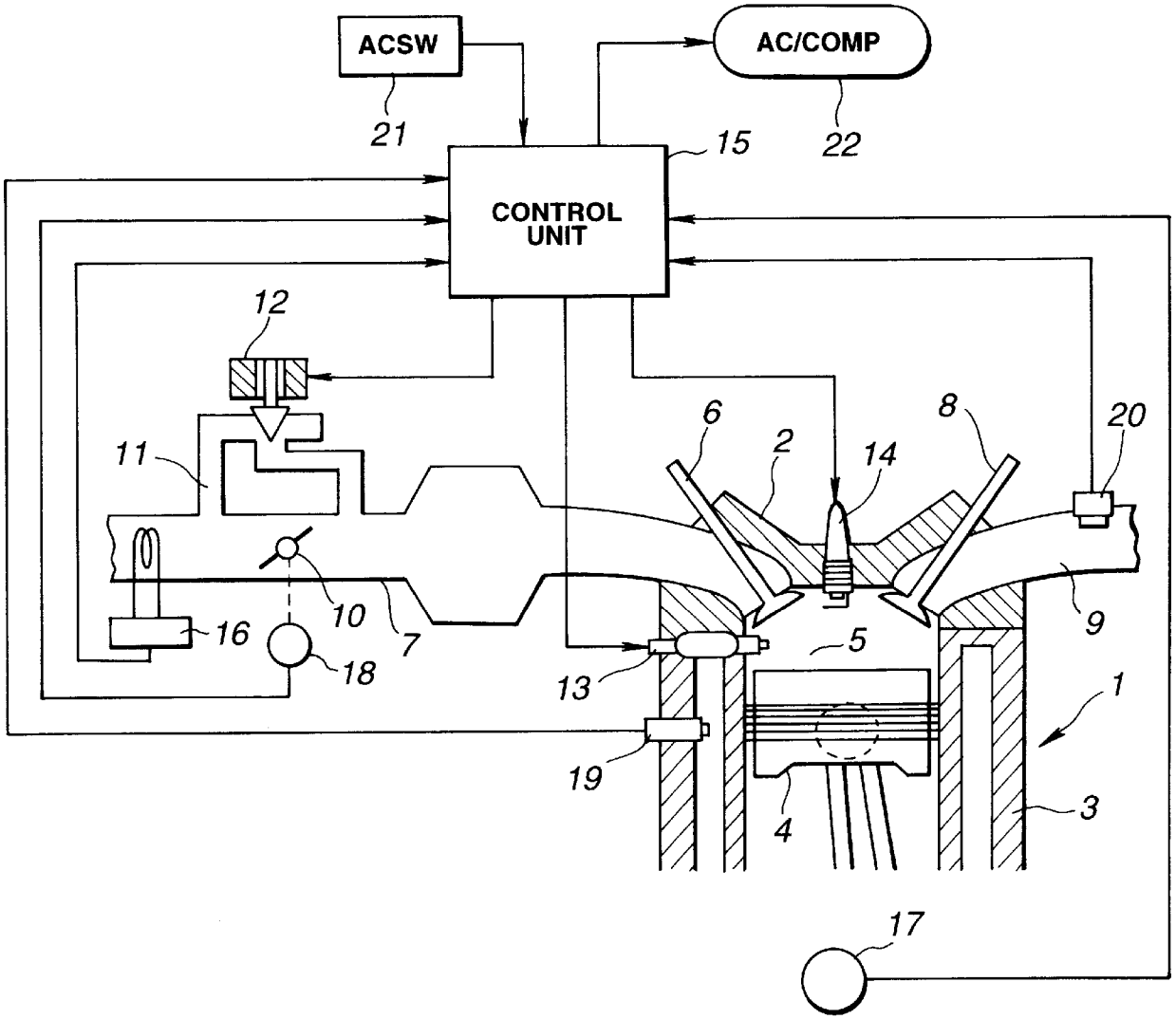
FIG. 3 is a schematic view showing a control system according to a preferred embodiment of the present invention.

FIG. 3 shows an idle speed control system according to one embodiment of the present invention.

An internal combustion engine 1 has a plurality of combustion chambers 5 each defined by a cylinder head 2, a cylinder block 3 and a piston 4. Each combustion chamber 5 is connected through an intake valve 5 with an intake passage 7, and through an exhaust valve 8 with an exhaust passage 9.

A throttle valve 10 connected with an accelerator pedal is disposed in the intake passage 7 at a position upstream of an intake manifold. The throttle valve 10 controls an intake air quantity.

A bypass passage 11 bypasses the throttle valve 10. An auxiliary air valve 12 of a step motor type is disposed in the bypass passage 11. The auxiliary air valve 12 controls an auxiliary air quantity (≈the intake air quantity during idling operation) by varying its opening degree in response to a control signal produced by a control unit 15.

An electromagnetic type fuel injector (or injection valve) 13 is inserted into each combustion chamber 5. In response to a drive pulse signal from the control unit 15, each fuel injector 13 injects a controlled amount of fuel at a predetermined timing synchronous with the engine revolution.

A spark plug 14 is inserted into each combustion chamber 5. In response to a control signal from the control unit 15, each spark plug 14 ignites an air fuel mixture in the combustion chamber 5 with the aid of an ignition coil (not shown) at a controlled timing.

To control the auxiliary air valve 12, the fuel injectors 13 and the spark plugs 14, the control unit 15 receives signals from various sensors.

An air flow sensor (or air flow meter) 16 of this example is of a hot wire type. The air flow sensor 16 is disposed in the intake passage 7 on the upstream side of the throttle valve 10. The air flow sensor 16 senses an intake air quantity (or intake air flow rate) Q.

A crank angle sensor 17 produces a pulse of a reference signal in each angular displacement of the crank shaft (on each occurrence of combustion). The control system can calculate an engine rotational speed N from the repetition period of the reference signal or the like.

A throttle position sensor 18 of a potentiometer type is connected with the throttle valve 10. The throttle position sensor 18 senses a throttle opening (degree) TVO. The throttle position sensor 18 of this example has, therein, an idle switch which turns on when the throttle valve 10 is at a closed or idling position for a minimum throttle setting.

A coolant temperature sensor 19 is inserted in a water jacket of the cylinder block 3, and arranged to sense a cooling water temperature TW of the engine 1.

An $O_2$ sensor 20 is inserted in the exhaust passage 9. The oxygen sensor 20 produces a sensor output signal representing the oxygen content in the exhaust which is closely related to the air-fuel ratio of the intake mixture of the engine 1.

The control system is arranged to control an external load which, in this example, is in the form of an air conditioner. An air conditioner switch 21 is connected with the control unit 15. The control unit 15 receives a signal from the air conditioner switch 21 to detect an operation request to the air conditioner. The control unit is further connected with an air conditioning compressor 22, and arranged to control the operation of the compressor 22 by sending a signal thereto.

Figure 4:
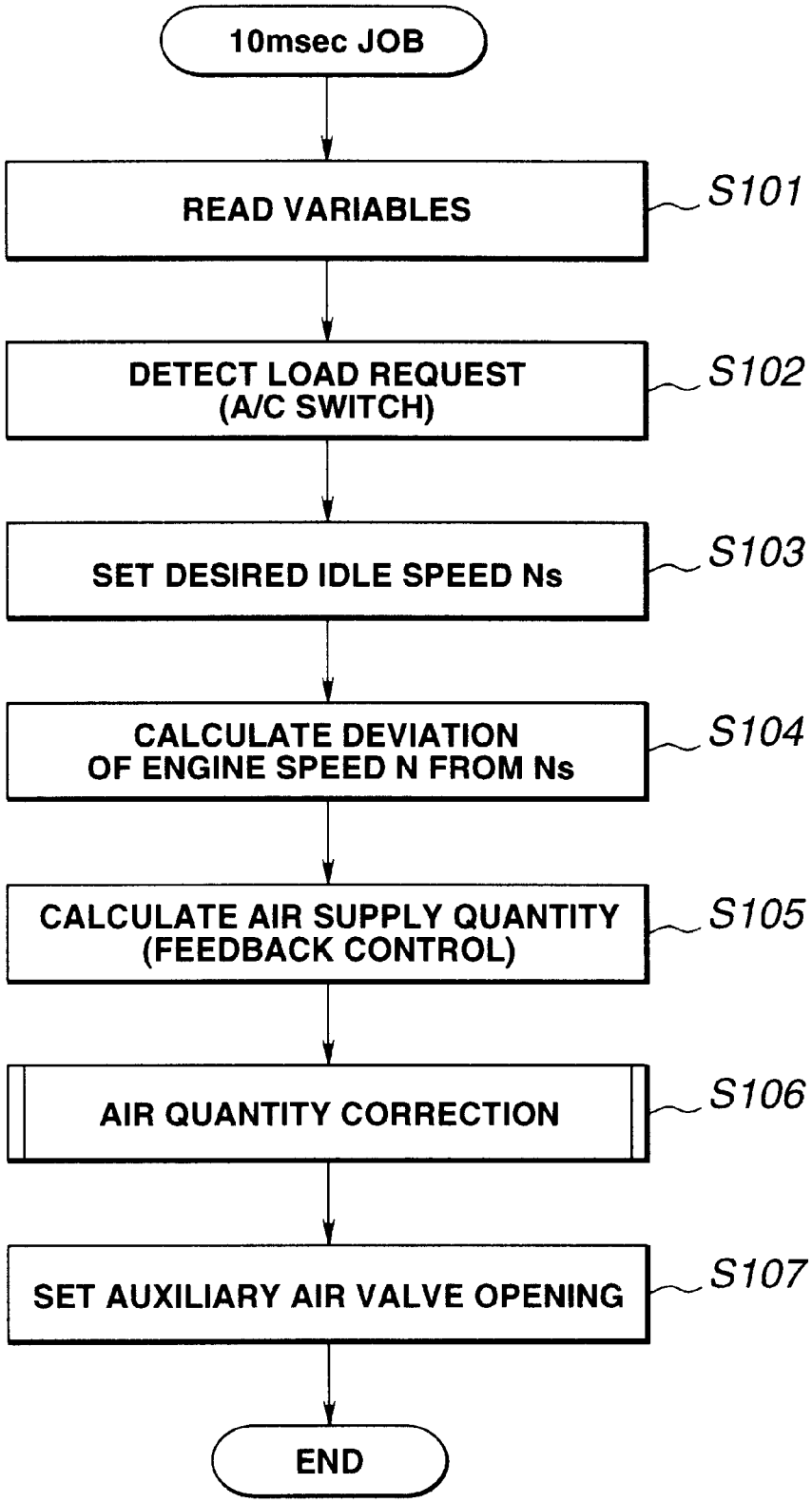
FIG. 4 is a flowchart showing a periodical control job performed by the control system of FIG. 3.
Figure 5:
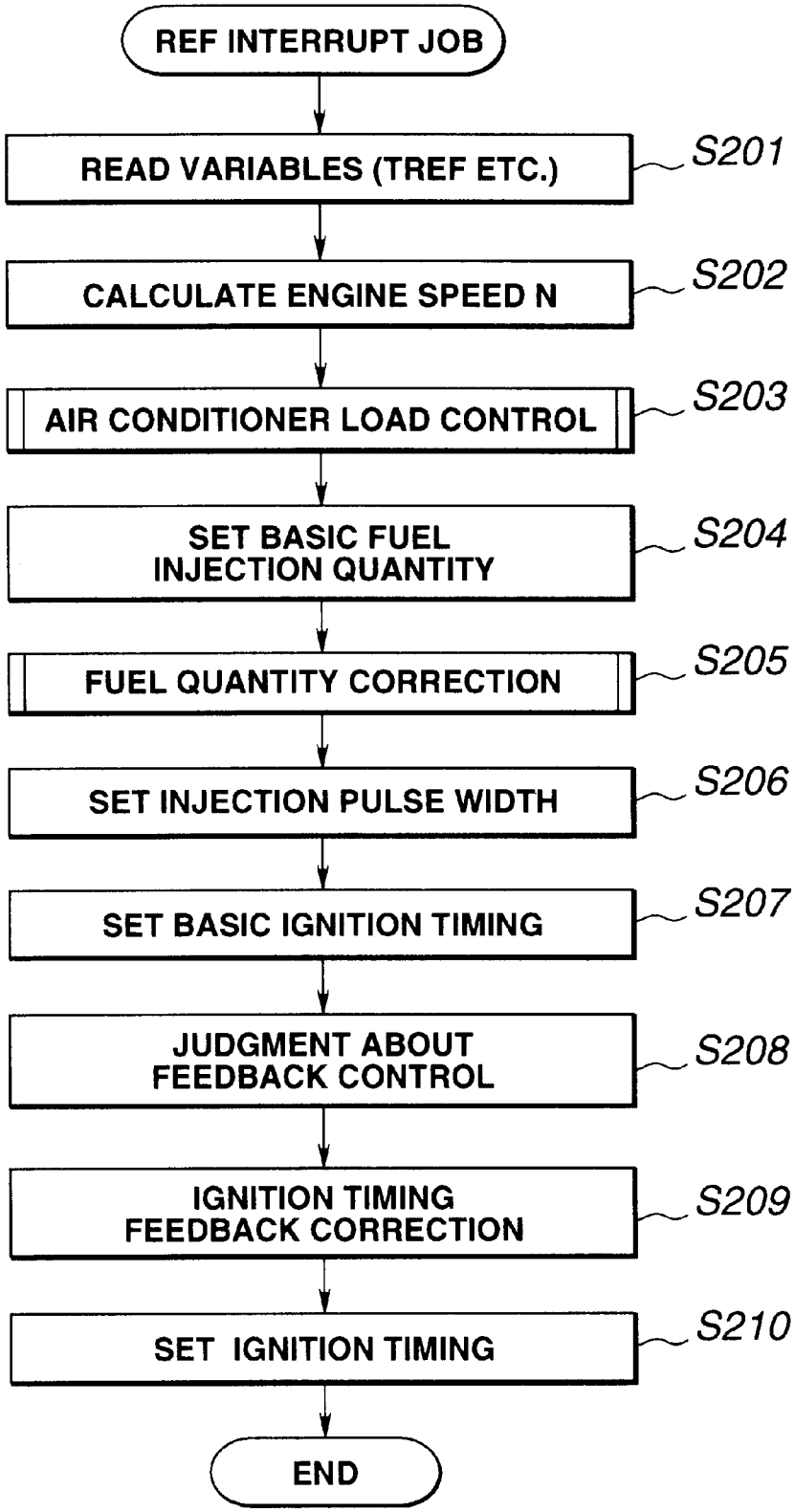
FIG. 5 is a flowchart showing an interrupt control job performed by the control system of FIG. 3.

The control unit 15 of this example includes CPU, ROM, RAM, and input and output interfaces, and performs a control according to control jobs shown in FIGS. 4 and 5.

Each control job includes one or more steps for the normal operation and one or more steps for the idling operation. The steps for the normal operation are performed not only in the idling operation but also in the normal operation of the engine 1 whereas the steps for the idling operation are performed only in the idling operation. The steps for the idling operation are preceded by an idle discriminating step for discriminating the idling condition of the engine 1. FIGS. 4 and 5 omits the idle discriminating step and show sequences of control operations followed in the case of the engine idling operation.

FIG. 4 is a periodical job which, in this example, is performed at regular intervals of 10 msec.

At a step S110, the control unit 15 reads various variables which are inputted from the sensors and stored in the memory.

At a step S102, the control unit 45 detects the condition of the air conditioner switch 21 as a load request. The control unit 15 sets ACSW to one (ACSW=1) if the air conditioner switch 21 is ON, and resets ACSW to zero (ACSW=0) when the air conditioner switch 21 is OFF. This step corresponds to a load increasing operation request detecting means and a load decreasing operation request detecting means.

At a step S103, the control unit 15 determines a desired idle speed Ns in accordance with engine operating conditions (mainly in accordance with the engine coolant temperature TW).

At a step S104, the control unit 15 calculates a deviation between the sensed actual engine speed N and the desired idle speed Ns.

At a step S105, the control unit 15 calculates a feedback quantity to an air supply quantity so as to reduce the deviation, and calculates the air supply quantity in accordance with the feedback quantity.

Figure 6:
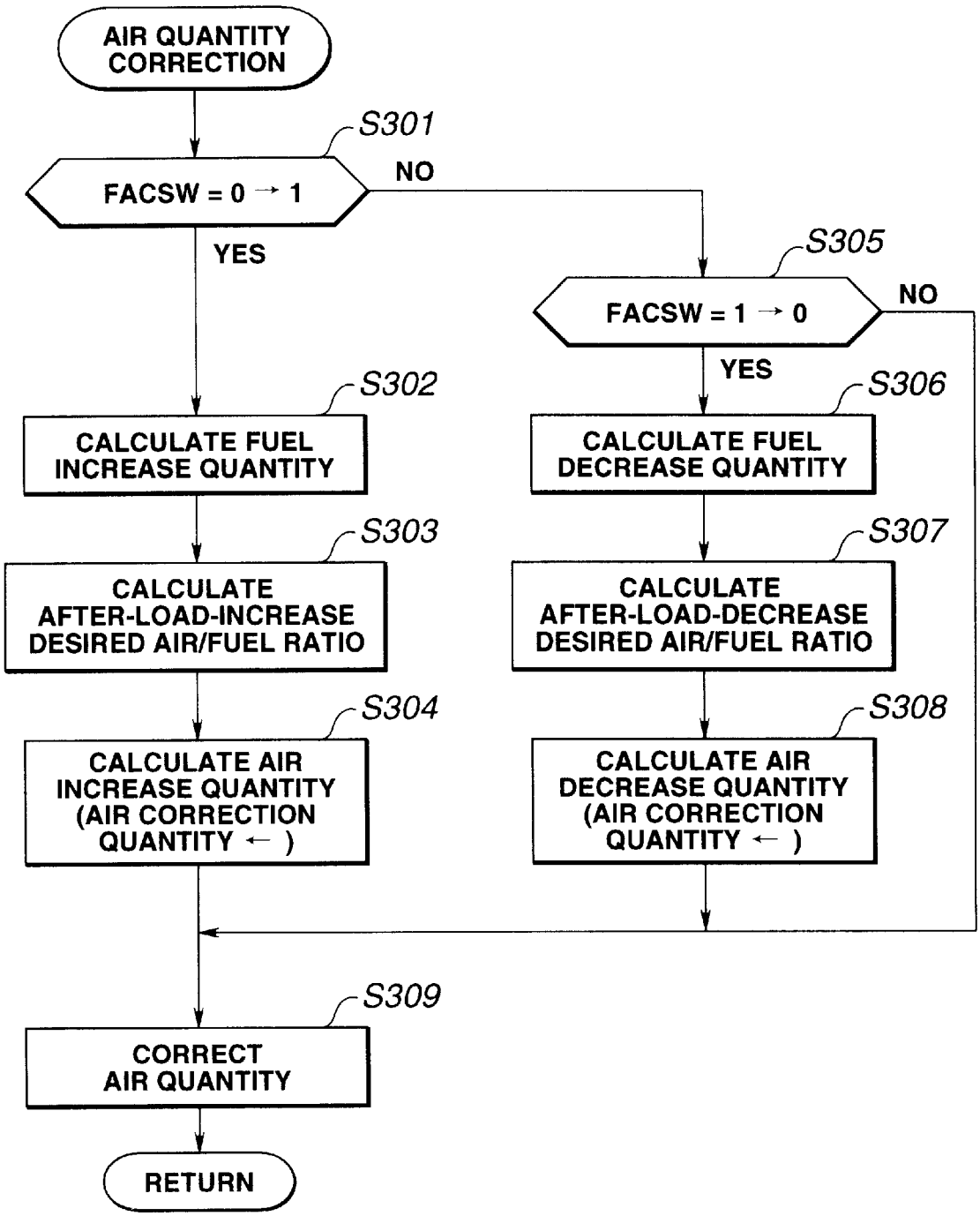
FIG. 6 is a flowchart showing an air supply quantity correcting procedure performed by the control system of FIG. 3.

At a step S106, the control unit 15 performs an air quantity correction shown in FIG. 6.

At a step S107, the control unit 15 sets the opening of the auxiliary air valve 12 so as to obtain an after-correction air supply quantity determined by the air quantity correction.

FIG. 5 shows an interrupt job performed immediately after the occurrence of each reference signal pulse (REF) produced each time combustion occurs.

At a step S201, the control unit 15 reads, from the memory, variables such as a period TREF of occurrences of combustion.

At a step S202, the control unit 15 calculates the engine rotational speed N from TREF.

Figure 7:
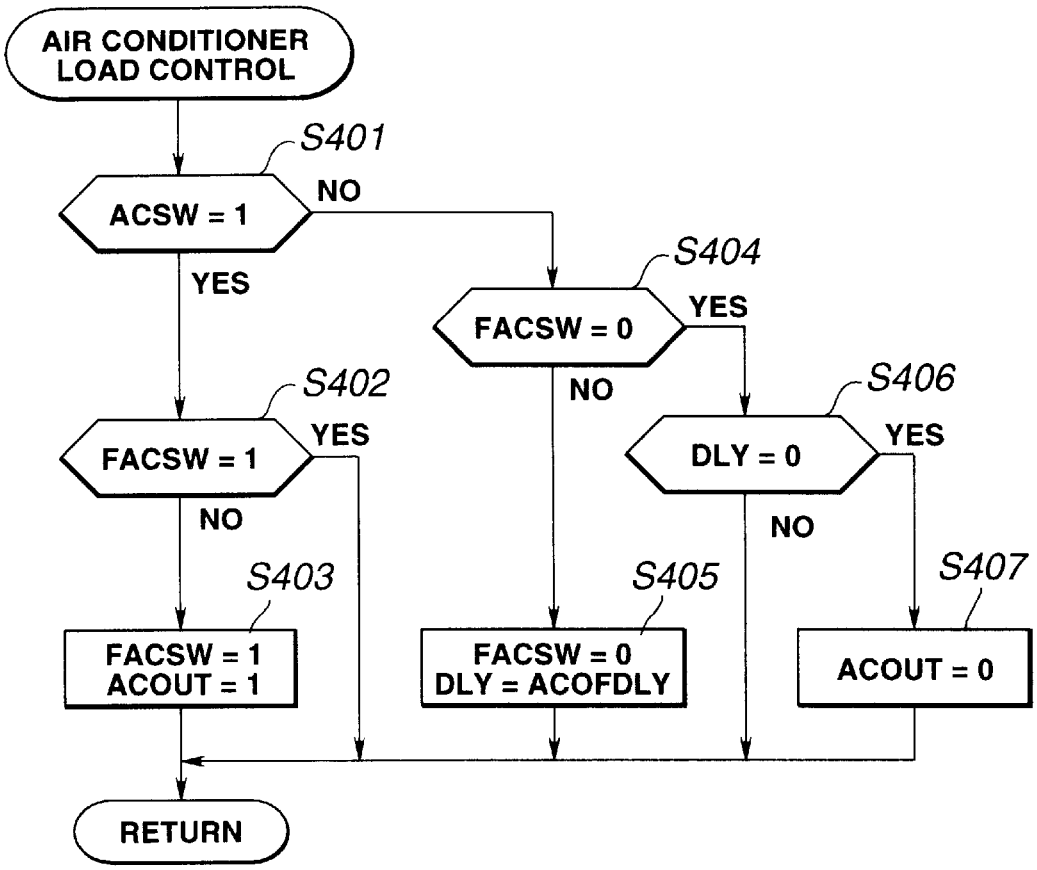
FIG. 7 is a flowchart showing an air conditioner load controlling procedure performed by the control system of FIG. 3.

At a step S203, the control unit 15 performs an air conditioner load control shown in FIG. 7.

At a step S204, the control unit 15 determines a basic fuel injection quantity Tp (=K·Q/N; K is a constant) in accordance with the engine operating conditions (mainly in accordance with the intake air flow rate Q and the engine speed N).

Figure 8:
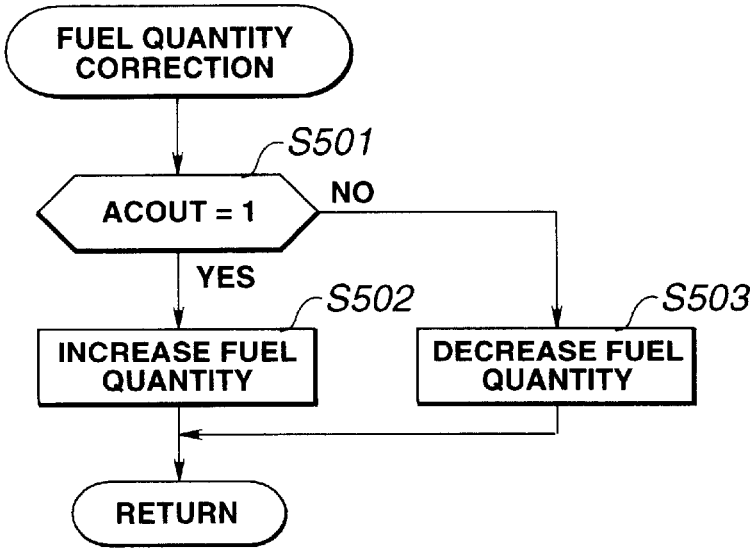
FIG. 8 is a flowchart showing a fuel supply quantity correcting procedure performed by the control system of FIG. 3.

At a step S205, the control unit 15 performs a fuel quantity correction as shown in FIG. 8.

At a step S206, the control unit 15 determines the injection pulse width of the drive pulse signal to the fuel injectors 13 so as to obtain an after-correction fuel injection quantity.

At a step S207, the control unit 15 determines a basic ignition timing in accordance with the engine operating conditions (mainly in accordance with the engine speed N and the basic fuel injection quantity Tp).

At a step S208, the control unit 15 determines whether or not to perform a feedback ignition timing control to stabilize the idling operation.

At a step S209, only when the feedback ignition timing control is to be performed, the control unit 15 calculates an ignition timing feedback quantity in such a direction as to restrain rotation fluctuation and corrects the ignition timing in accordance with the ignition timing feedback quantity. If the feedback ignition timing control is not to be performed, the control unit 15 sets the ignition timing equal to the basic ignition timing.

At a step S210, the control unit 15 sets the ignition timing to ignite the air/fuel mixture in each combustion chamber at the controlled correct instant.

FIG. 6 shows the air quantity correcting procedure. In this correcting procedure, the control system performs a decreasing correction when the air conditioner switch 21 turns from ON to OFF, and performs an increasing correction immediately when the air conditioner switch 21 turns from OFF to ON.

At a step S301, the control unit 15 determines whether an air conditioner switch flag FACSW is changed from 0 to 1. By a procedure of FIG. 7, the air conditioner flag FACSW is turned to 1 when the air conditioner switch 21 is turned from OFF to ON, and turned to 0 when the air conditioner switch 21 is turned from ON to OFF.

When FACSW is turned from 0 to 1 that is, when an addition of the air conditioner load is requested), the control unit 15 performs steps S302~S304 and then proceeds to a step S309.

At the step S302, the control unit 15 determines a fuel increase quantity by which the fuel injection quantity is increased when the air conditioner load is added. The step S302 corresponds to a fuel increase quantity calculating means.

Figure 2:
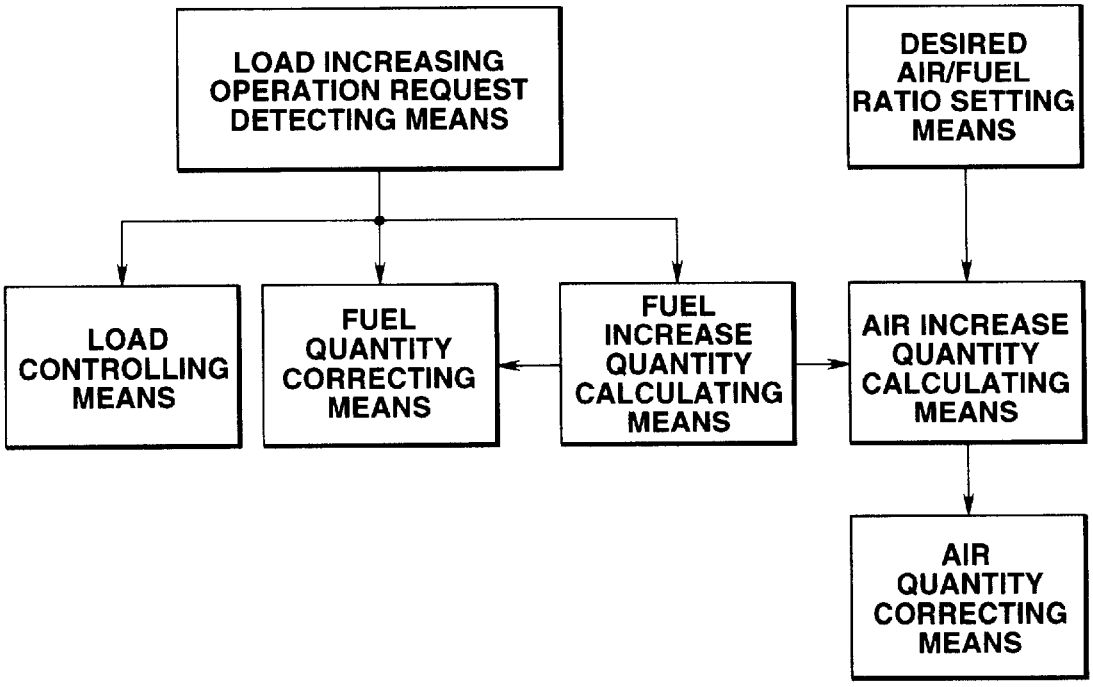
FIG. 2 is a block diagram showing a second arrangement of various means according to the present invention.

At the step S303, the control unit 15 determines an after-load-addition desired air fuel/ratio for use after the addition of the air conditioner load. The step S303 corresponds to a desired air fuel ratio setting means shown in FIG. 2.

At the step S304, the control unit 15 determines an air increase quantity to be added after the addition of the air conditioner load, in accordance with the fuel increase quantity and the after-load-addition desired air fuel ratio, and sets the thus-determined quantity as an air correction quantity. This step corresponds to an air increase quantity calculating means.

At a step S305, the control unit 15 determines whether the air conditioner switch flag FACSW is changed from 1 to 0. When FACSW is changed from 1 to 0 (that is, when a removable of the air conditioner load is requested), the control unit 15 performs steps S306~S308 and then proceeds to the step S309.

At the step S306, the control unit 15 determines a fuel decrease quantity by which the fuel injection quantity is decreased when the air conditioner load is removed. The step S306 corresponds to a fuel decrease quantity calculating means.

Figure 1:
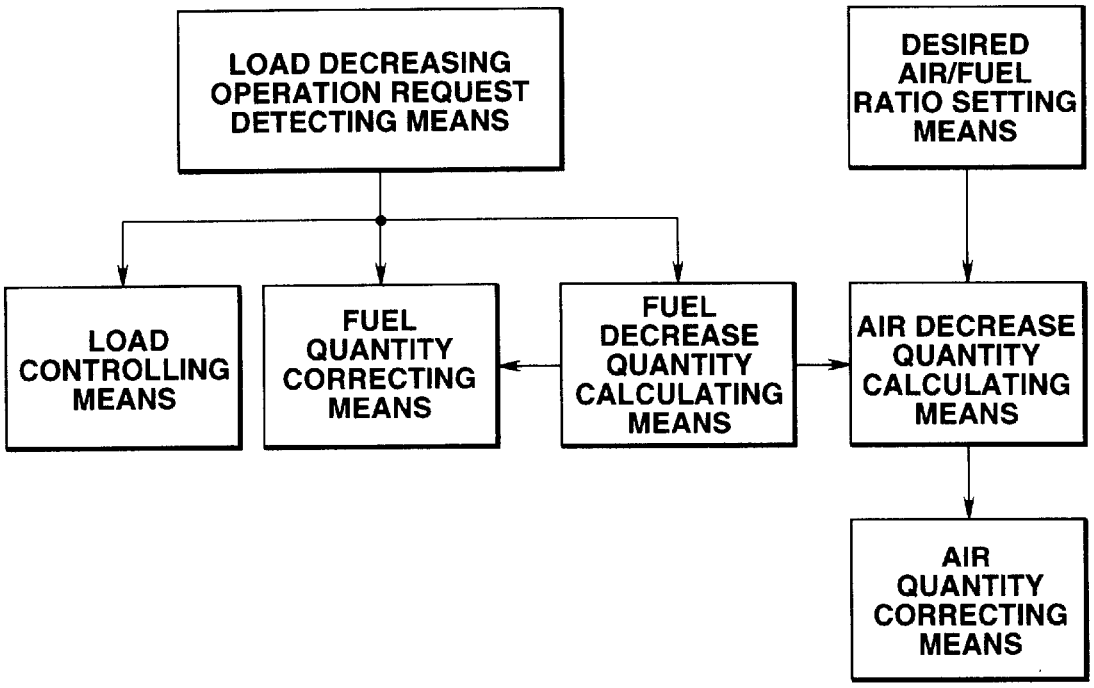
FIG. 1 is a block diagram showing a first arrangement of various means according to the present invention.

At the step S307, the control unit 15 determines an after-load-removal desired air fuel ratio for use after the removal of the air conditioner load. The step S307 corresponds to a desired air fuel ratio setting means shown in FIG. 1.

At the step S308, the control unit 15 determines an air decrease quantity to be subtracted after the removal of the air conditioner load, in accordance with the fuel decrease quantity and the after-load-removal desired air fuel ratio, and sets the thus-determined quantity as the air correction quantity. This step corresponds to an air decrease quantity calculating means.

The step S309 is reached after the execution of the air increasing program section of S302~S304 or the air decreasing program section of S306~S308, or the step S309 is reached directly when the value of FACSW remains unchanged. At the step S309, the control unit 15 corrects the air supply quantity in accordance with the currently set value of the air correction quantity. This step corresponds to an air quantity correcting means.

FIG. 7 shows an air conditioner load control procedure. In this procedure, the control system stops the air conditioning compressor 22 after the elapse of a predetermined time (0.5 sec, in this example) when the air conditioner switch 21 is turned from ON to OFF, and starts driving the air conditioning compressor 22 immediately when the air conditioner switch 21 is turned from OFF to ON.

At a step S401, the control unit 15 examines whether the air conditioner switch 21 is ON (ACSW=1) or not. The control unit 15 proceeds to a step S402 when the air conditioner switch 21 is ON (ACSW=1).

At the step S402, the control unit 15 examines whether the air conditioner switch flag FACSW is equal to one.

When the air conditioner flag FACSW=0 (in the case of the first execution after the air conditioner switch 21 is turned to ON), the control unit 15 proceeds to a step S403. At the step S403, the control unit 15 sets the air conditioner switch flag FACSW to one, and drives the air conditioning compressor 22 by setting ACCUT to one. This step corresponds to a load controlling means. When the air conditioner switch flag FACSW=1, the control unit 15 terminates this procedure immediately.

When the air conditioner switch 21 is OFF (ACSW=0), the control unit 15 proceeds to a step S404.

At the step S404, the control unit 15 determines whether the air conditioner switch flag FACSW is equal to zero or not.

When the air conditioner switch flag FACSW=1 (the first time after the air conditioner switch 21 is turned to OFF), then the control unit 15 proceeds to a step S405.

At the step S405, the control unit 15 resets the air conditioner switch flag FACSW to zero (FACSW=0), and sets a timer DLY to an initial value of ACOFDLY. The timer DLY is decreased periodically at regular intervals of a predetermined time length. Thus, the control unit 15 starts time measurement to signal the expiration of a predetermined time.

Thereafter, the control unit 15 takes the route from the step S404 to a step S406 since the air conditioner switch flag FACSW is set to zero.

At the step S406, the control unit 15 checks whether the timer DLY is reduced to zero, to determine whether the predetermined time interval has elapsed. When the predetermined time interval has elapsed and hence DLY=0, the control unit 15 proceeds to a step S407.

At the step S407, the control unit 15 stops driving the air conditioning compressor 22 by setting ACOUT to 0. This section corresponds to a load controlling means.

FIG. 8 shows a fuel supply quantity correcting procedure. This procedure is arranged to perform an increase correction when ACOUT=1 and a decrease correction when ACOUT=0, to perform the fuel supply quantity correction in synchronism with the air conditioner load control.

At a step S501, the control unit 15 checks whether ACOUT=1 or not (that is, whether or not the air conditioner is in operation).

When ACOUT=1 (the air conditioner is in operation), the control unit 15 proceeds to a step S502, and increases the fuel injection quantity in accordance with the fuel increase quantity calculated by the step S302.

When ACOUT=0 (the air conditioner is out of operation), the control unit 15 proceeds to a step S503, and decrease the fuel injection quantity in accordance with the fuel decrease quantity calculated by the step S306.

The steps S502 and S503 correspond to fuel quantity correcting means.

Figure 9:
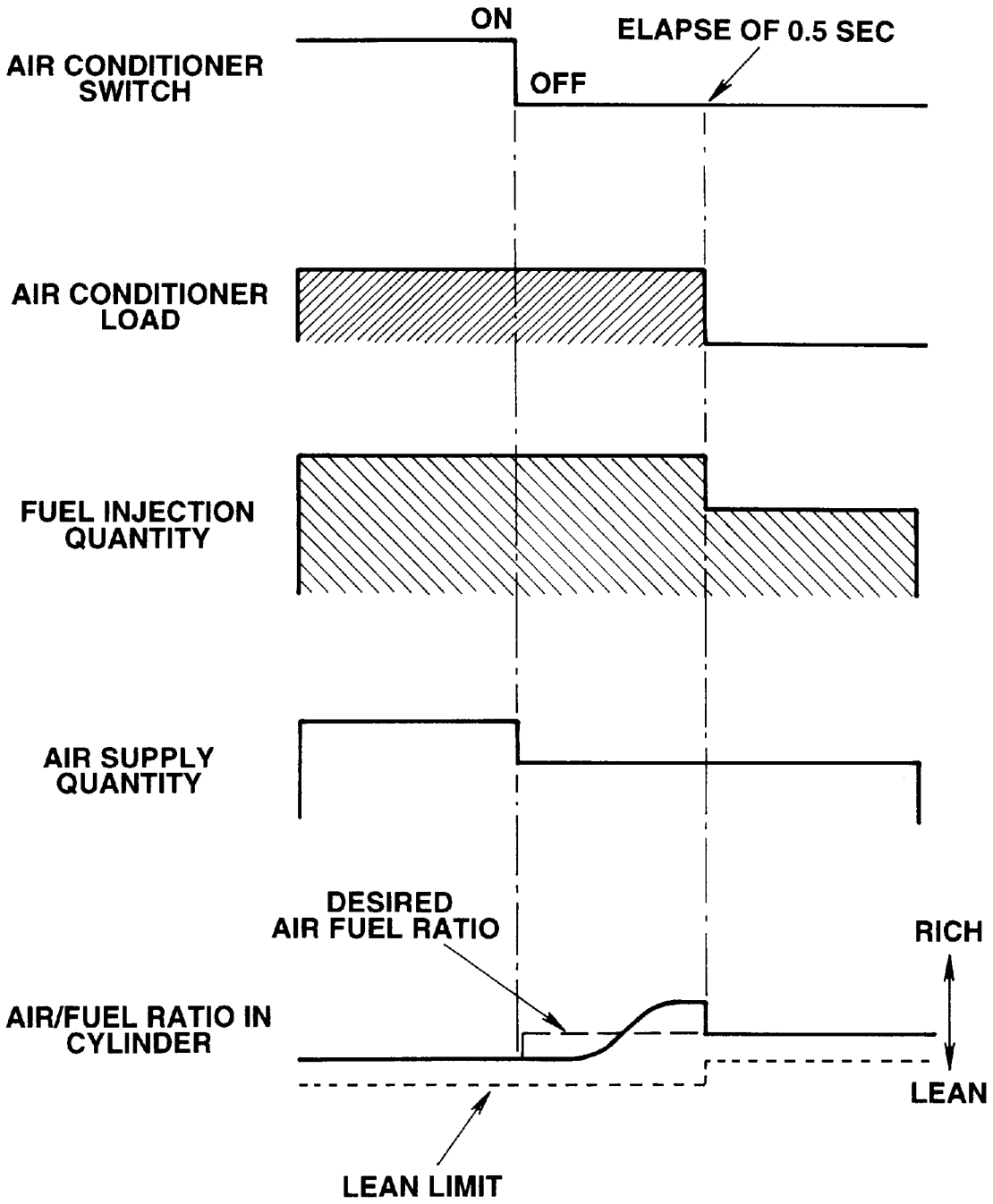
FIG. 9 is a view showing performance characteristics of the control system of FIG. 3 when an air conditioner load is removed.
Figure 10:
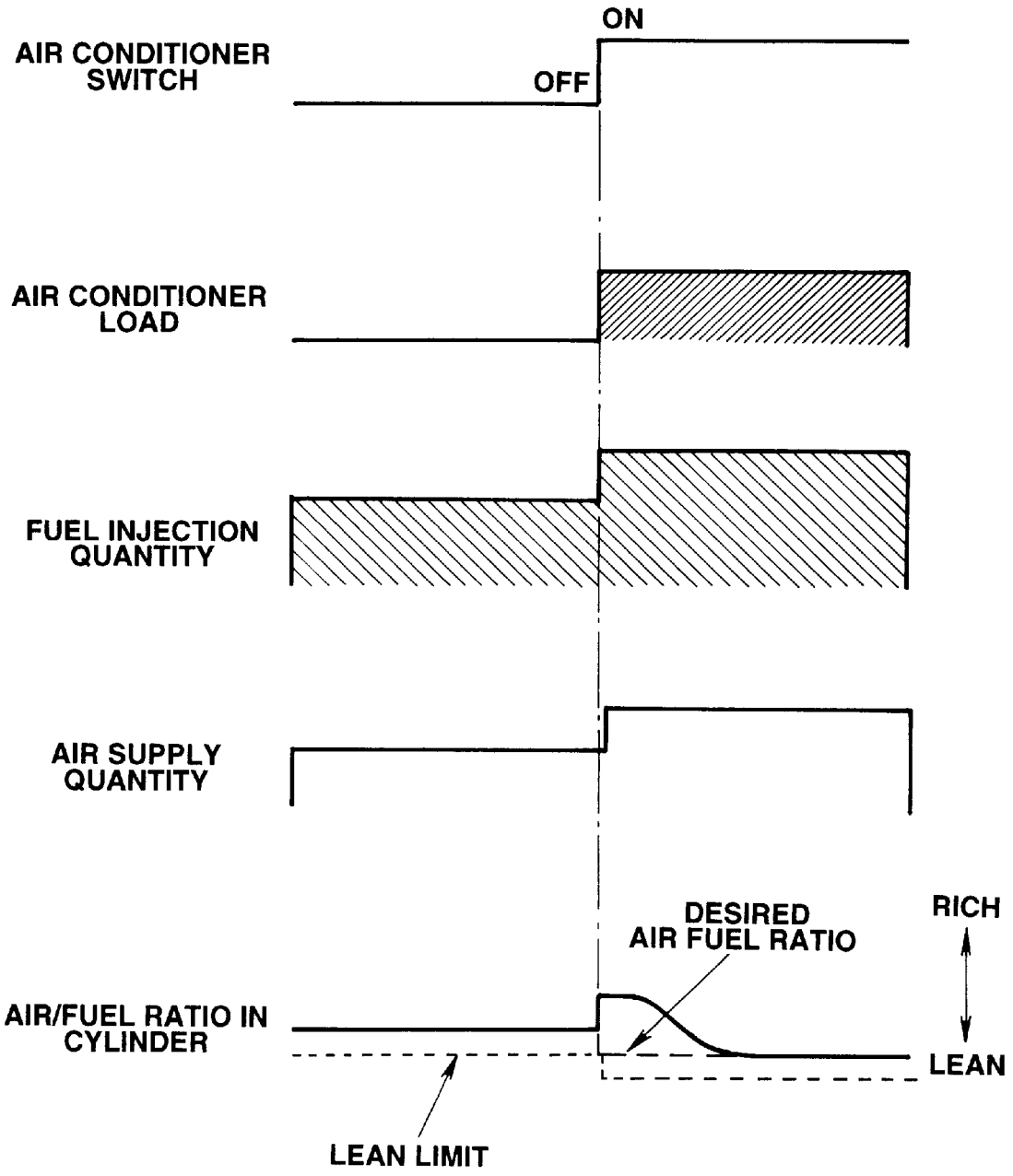
FIG. 10 is a view showing performance characteristics of the control system of FIG. 3 when the air conditioner load is imposed.

FIGS. 9 and 10 show variations of the air conditioner switch, air conditioner load, fuel injection quantity, air supply quantity, and air/fuel ratio in the control system according to this embodiment. In this example, the engine is a so-called a direct-injection lean burn engine in which the fuel is injected directly into each cylinder, and the air fuel ratio is controlled in a lean state during the idling operation. The control system of this embodiment controls the idle speed of the direct-injection lean burn engine in response to the on/off switching of the air conditioner load in the following manner.

When the air conditioner switch 21 is turned from ON to OFF:

When the air conditioner switch 21 is turned off in the state in which the air conditioner load is added and the air fuel mixture in each cylinder is lean, the control system varies the air fuel ratio of the air fuel mixture in each cylinder to a richer condition by decreasing the air supply quantity. Then, at the end of the predetermined time interval (0.5 sec, for example) after the occurrence of the request for turning off the air conditioner, the control system removes the air conditioner load, and at the same time decreases the fuel injection quantity by an amount corresponding to the decrease quantity of the air conditioner load while holding the air supply quantity constant. Therefore, the air/fuel ratio of the mixture in each cylinder is returned to a lean level. However, since the air fuel mixture is preliminarily made slightly richer, this reduction of the fuel injection quantity does not make the air fuel mixture too lean beyond the lean limit.

In this case, it is optional to shift the timing of removing the air conditioner load and the timing of decreasing the fuel injection quantity with respect to each other so that the actual decrease in the output torque of the engine is coincident with the actual decrease of the engine. Such a time difference further improves the engine performance.

When the air conditioner is turned from OFF to ON:

The air conditioner switch 21 is turned on in the state in which the engine is free from the air conditioner load, and the air fuel mixture is lean. If, in such a case, the air conditioner load is added simultaneously with the increase of the fuel injection quantity, then the increase of the fuel injection quantity results in a slight enrichment of the air fuel mixture. Since the desired air/fuel ratio remains the same as before the addition of the air conditioner load, the incremental correction of the air supply quantity enleans the air fuel mixture gradually, to the original lean level.

In this case, it is optional to shift the timing of adding the air conditioner load and the timing of increasing the fuel injection quantity with respect to each other so as to make coincident the timing of actual increase of the load and the timing of actual increase of the output torque of the engine. Such a time difference further improves the engine performance.

According to the illustrated embodiment, a control system for an internal combustion engine (1) equipped with a main throttle valve (10), an auxiliary air valve (12) and a fuel supplying apparatus (13) such as a fuel injection system having fuel injectors, comprises an external load unit (22), a switching device (21), a sensing device (18) and a control unit (15). The external load unit decreases the engine load imposed on the internal combustion engine when the external load unit is put in a predetermined low load state, and increase the engine load when the external load unit is in a predetermined high load state. In the illustrated embodiment, the external load unit is an air conditioner having, as a main component, an air conditioning compressor (22). The air conditioner may further comprise an actuator, such as an electromagnetic clutch, for making and breaking a driving connection between the compressor and the engine and thereby switching the air conditioner between the low and high load states. The switching device (21) produces a decrease request signal (or A/C turn-off signal) for requesting a change of the external load unit from the high load state (or an on state) to the low load state (or an off state). The sensing device (18) produces an idle condition signal when the engine is in an idling condition.

In response to the decrease request signal from the switching device, during the engine idling operation, the control unit decreases the engine load by switching the external load unit from the high load state to the low load state, and further decreases the air supply quantity and the fuel supply quantity. The control unit of the illustrated embodiment delays the decrease of the fuel injection quantity and the switching operation of the external load unit from the high load state to the low load state after the decrease of the air supply quantity. To do this, the control unit produces an air decrease command signal to command the auxiliary air valve to decrease the air supply quantity immediately upon receipt of the decrease request signal from the switching device, then produces a fuel decrease command signal to command the fuel supplying apparatus (such as the fuel injection system) to decrease the fuel supply quantity after the elapse of a predetermined first time interval from receipt of the decrease request signal, and further produces a load decrease command signal to switch the external load unit from the high load state to the low load state after the elapse of a second predetermined time interval from receipt of the decrease request signal. In the illustrated example, the first and second time intervals are equal to each other. The auxiliary air valve may comprise a valve element and a stepper motor for moving the valve element.

This control system decreases the fuel injection quantity simultaneously with the decrease of the load. Therefore, the control system can follow up changes in the load faithfully and responsively. Furthermore, this control system decreases the air supply quantity beforehand to enrich the air fuel mixture. Therefore, this control system can prevent the air fuel mixture from reaching the lean limit by the decrease of the fuel injection quantity and maintain the stable condition of combustion.

The switching device (21) according to the illustrated embodiment further produces an increase request signal (or A/C turn-on signal) for requesting a change of the external load unit from the low load state to the high load state. In response to the increase request signal, the control unit increases the engine load by switching the external load unit from the low load state to the high load state, and further increases the air supply quantity and the fuel supply quantity. In the control system of the illustrated embodiment, the increase of the air supply quantity is slightly delayed with respect to the increase of the fuel injection quantity and the switching operation of the external load unit from the low load state to the high load state. The control unit of the illustrated embodiment produces an air increase command signal to command the auxiliary air valve to increase the air supply quantity, a fuel increase command signal to cause the fuel supplying apparatus to increase the fuel supply quantity, and a load increase command signal to switch the external load unit from the low load state to the high load state upon receipt of the increase request signal.

This control system increases the fuel injection quantity simultaneously with the increase of the load. Therefore, the control system can follow up changes in the load faithfully and responsively. Thereafter, the air supply quantity is increased. This control system, therefore, can improve the fuel consumption and the emission control by preventing the air fuel mixture from remaining rich.

The thus-constructed control system of the illustrated embodiment decreases the air supply quantity beforehand in the case of the turn-off operation of the air conditioner whereas, in the case of the turn-on operation of the air conditioner, the air supply quantity is increased later. In the illustrated example, an intentional delay (of 0.5 sec, for example) is introduced only in the case of the turn-off operation.

In the illustrated example, the desired idle speed Ns set by the control unit 15 at the step S103 of FIG. 4 varies in dependence of the condition of the external load unit. When, for example, an automatic transmission of the vehicle is in the D range, the desired idle speed Ns is set equal to 650 rpm in the case of the air conditioner being OFF, and equal to 700 rpm in the case of the air condition being ON (provided that the engine coolant temperature and other operating conditions remain unchanged). In the N range of the automatic transmission, the desired idle speed Ns is set equal to 750 rpm in the OFF state of the air conditioner, and to 850 rpm in the ON state of the air conditioner. In this way, the desired idle speed Ns is increased when the air conditioner is turned on.

At the step 303 or 307 of FIG. 6, the control unit 15 of the illustrated example determines the after-load-variation desired air/fuel ratio in accordance with the engine speed and the quantity of the air flowing into the cylinder (or the boost), so as to prevent the engine speed from being made unstable by the excess or deficiency of the driving torque after the removal or addition of the external load. At an engine speed of 700 [rpm], for example, the engine torque (or shaft torque) decreases as the air/fuel ratio increases (toward the lean side). Assuming that, when the air conditioner is to be turned from ON to OFF, the engine is operated at an air/fuel ratio of 14.7, producing an engine torque of 9.0 [Kg·m], and the air conditioning compressor is driven by a torque of 5.0 [kg·m], then the engine torque for the OFF state of the air conditioner is set equal to 4.0 [kg·m] to prevent the excess or deficiency of the driving torque and hold the engine speed stable. The desired air/fuel ratio is set to a value (30, for example) required to achieve the engine torque of 4.0 [kg·m].

At the steps S302 or S306 of FIG. 6, the control unit 15 of the illustrated example calculates the fuel increase or decrease quantity in accordance with the variation of the load torque (such as the torque for driving the air conditioning compressor). In this case, it is optional to employ a correction by the air/fuel ratio.

As mentioned before, there may be introduced a time difference between the timing of adding or removing the air conditioner load and the timing of increasing or decreasing the fuel injection quantity. In the case of a switching operation of the air conditioner switch from ON to OFF, an actual decrease of the compressor load may be slightly delayed (because the clutch between the compressor and the engine is controlled by a relay). Therefore, the simultaneous reduction of the fuel quantity may cause a premature reduction of the engine torque before the compressor load is actually removed from the engine, resulting in an undesired decrease of the engine speed. Therefore, the time difference is adjusted to cause the actual decrease (or increase) of the load, and the actual decrease (or increase) of the torque to occur simultaneously, on the basis of comparison between a delay from the generation of a command signal to change the load to an actual responsive change of the load and a delay from the generation of a command signal to change the fuel supply quantity to an actual responsive change of the engine torque.

What is claimed is:

1. An idle speed control system for controlling an idle speed of an internal combustion engine, the control system comprising:

load decreasing operation request detecting means for detecting a load decreasing operation request for an operation causing a decrease of a load on the engine;

desired air/fuel ratio setting means for setting a desired air/fuel ratio of an air fuel mixture supplied to the engine in accordance with an engine operating condition;

fuel decrease quantity calculating means for calculating a fuel decrease quantity for decreasing a fuel injection quantity in case of detection of the load decreasing operation request;

air decrease quantity calculating means for calculating an air decrease quantity for decreasing an air supply quantity in accordance with the desired air fuel ratio and the fuel decrease quantity in case of detection of the load decreasing operation request;

air supply quantity correcting means for decreasing the air supply quantity in accordance with the air decrease quantity in case of detection of the load decreasing operation request;

load controlling means for decreasing the load on the engine at an end of a preset time interval from detection of the load decreasing operation request; and fuel supply quantity correcting means for decreasing the fuel injection quantity in accordance with the fuel decrease quantity at an end of a preset time interval from detection of the load decreasing operation request, the load controlling means and the fuel quantity correcting means being timed so that there is a time difference between a load decreasing operation of the load controlling means and a fuel decreasing operation of the fuel supply quantity correcting means, to cause an actual decrease of a load torque applied on the engine and an actual decrease of an output torque of the engine to coincide with each other.

2. An idle speed control system for controlling an idle speed of an internal combustion engine, the control system comprising:

load decreasing operation request detecting means for detecting a load decreasing operation request for an operation causing a decrease of a load on the engine;

desired air/fuel ratio setting means for setting a desired air/fuel ratio of an air fuel mixture supplied to the engine in accordance with an engine operating condition;

fuel decrease quantity calculating means for calculating a fuel decrease quantity for decreasing a fuel injection quantity in case of detection of the load decreasing operation request;

air decrease quantity calculating means for calculating an air decrease quantity for decreasing an air supply quantity in accordance with the desired air fuel ratio and the fuel decrease quantity in case of detection of the load decreasing operation request;

air supply quantity correcting means for decreasing the air supply quantity in accordance with the air decrease quantity in case of detection of the load decreasing operation request;

load controlling means for decreasing the load on the engine at an end of a preset time interval from detection of the load decreasing operation request; and fuel supply quantity correcting means for decreasing the fuel injection quantity in accordance with the fuel decrease quantity at an end of a preset time interval from detection of the load decreasing operation request, the desired air/fuel ratio setting means including means for determining a desired air/fuel ratio after the decrease of the load, the fuel decrease quantity calculating means including means for calculating the fuel decrease quantity corresponding to an output torque required to maintain a desired idle speed after the decrease of the load, and the air decrease quantity calculating means including means for calculating the air decrease quantity in accordance with the desired air/fuel ratio after the decrease of the load, and the fuel decrease quantity.

3. An idle control system for controlling an idle speed of an internal combustion engine, the control system comprising:

load increasing operation request detecting means for detecting a load increasing operation request for an operation causing a increase of a load on the engine;

desired air/fuel ratio setting means for setting a desired air/fuel ratio of an air fuel mixture supplied to the engine in accordance with an engine operating condition;

fuel increase quantity calculating means for calculating a fuel increase quantity for increasing a fuel injection quantity in case of detection of the load increasing operation request;

air increase quantity calculating means for calculating an air increase quantity for increasing an air supply quantity in accordance with the desired air fuel ratio and the fuel increase quantity in case of detection of the load increasing operation request;

load controlling means for increasing the load in case of detection of the load increasing operation request;

fuel supply quantity correcting means for increasing the fuel injection quantity in accordance with the fuel increase quantity in case of detection of the load increasing operation request; and air supply quantity correcting means for increasing the air supply quantity in accordance with the air increase quantity in case of detection of the load reducing operation request, the load controlling means and the fuel quantity connecting means being timed so that there is a time difference between a load increasing operation of the load controlling means and a fuel increasing operation of the fuel supply quantity correcting means, to cause an actual increase of a load torque applied on the engine and an actual increase of an output torque of the engine to coincide with each other.

4. An idle speed control system for controlling an idle speed of an internal combustion engine, the control system comprising:

load increasing operation request detecting means for detecting a load increasing operation request for an operation causing a increase of a load on the engine;

desired air/fuel ratio setting means for setting a desired air/fuel ratio of an air fuel mixture supplied to the engine in accordance with an engine operating condition;

fuel increase quantity calculating means for calculating a fuel increase quantity for increasing a fuel injection quantity in case of detection of the load increasing operation request;

air increase quantity calculating means for calculating an air increase quantity for increasing an air supply quantity in accordance with the desired air fuel ratio and the fuel increase quantity in case of detection of the load increasing operation request;

load controlling means for increasing the load in case of detection of the load increasing operation request;

fuel supply quantity correcting means for increasing the fuel injection quantity in accordance with the fuel increase quantity in case of detection of the load increasing operation request; and air supply quantity correcting means for increasing the air supply quantity in accordance with the air increase quantity in case of detection of the load reducing operation request, the fuel increase quantity calculating means including means for calculating the fuel increase quantity corresponding to an output torque required to maintain a desired idle speed after the increase of the load, and the air increase quantity calculating means including means for calculating the air increase quantity in accordance with a desired air/fuel ratio for an engine operating condition after an increase of the load, and the fuel increase quantity.

* * * * *